US009573388B2

(12) United States Patent
Katagami et al.

(10) Patent No.: US 9,573,388 B2
(45) Date of Patent: Feb. 21, 2017

(54) PRINTING METHOD AND PRINTING APPARATUS

(71) Applicant: SEIKO EPSON CORPORATION, Tokyo (JP)

(72) Inventors: Satoru Katagami, Matsumoto (JP); Kazuaki Sakurada, Suwa (JP); Kazuya Tajima, Matsumoto (JP); Kazuyoshi Tanase, Matsumoto (JP); Yuichi Washio, Matsumoto (JP); Kentaro Miyazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/934,759

(22) Filed: Nov. 6, 2015

(65) Prior Publication Data

US 2016/0129702 A1 May 12, 2016

(30) Foreign Application Priority Data

Nov. 10, 2014 (JP) ..... 2014-228071

(51) Int. Cl.
*B41J 2/01* (2006.01)
*B41J 11/00* (2006.01)

(52) U.S. Cl.
CPC ..... *B41J 11/0015* (2013.01); *B41J 11/002* (2013.01)

(58) Field of Classification Search
None
See application file for complete search history.

(56) References Cited

U.S. PATENT DOCUMENTS

2005/0270351 A1 12/2005 Mouri et al.
2009/0153613 A1 6/2009 Yamanobe
2010/0079524 A1* 4/2010 Saita ..... H04N 1/6033 347/14
2013/0201252 A1* 8/2013 Namba ..... C09D 5/00 347/21
2015/0224787 A1 8/2015 Ohtsuka

FOREIGN PATENT DOCUMENTS

| | | |
|---|---|---|
| JP | 2005-343049 | 12/2005 |
| JP | 2012-106350 | 6/2012 |
| JP | 05-103154 | 10/2012 |
| JP | 2014-083789 | 5/2014 |

OTHER PUBLICATIONS

Ohtsuka S., Printing Method Used for Printing Character . . . and Dye Ink on To-Be-Printed Product, May 1, 2014, Japan.*

* cited by examiner

*Primary Examiner* — Matthew Luu
*Assistant Examiner* — Tracey McMillion
(74) *Attorney, Agent, or Firm* — Workman Nydegger

(57) ABSTRACT

A printing method uses a reaction liquid containing an aggregating agent capable of causing the aggregation of a color material. This printing method includes: applying a first reaction liquid to a recording medium; applying a background color ink that contains a color material for a background color to a region of the recording medium which is coated with the first reaction liquid; drying the recording medium coated with the background color ink by heating the recording medium; applying a second reaction liquid to a region of the dried recording medium which is coated with the background color ink; and applying an image forming ink that contains a color material having a color different from that of the background color ink to a region of the recording medium which is coated with the second reaction liquid.

3 Claims, 5 Drawing Sheets

FIG. 5

| STEP | NECESSARY QUANTITY ($mg/in^2$) |
|---|---|
| S62 | 1.3 |
| S64 | 13.5 |
| S92 | 0.2 |
| S94 | 7.2 |
| S96 | 3.6 |
| S100 | – |
| TOTAL LIQUID QUANTITY | 25.8 |

FIG. 6

| STEP | NECESSARY QUANTITY ($mg/in^2$) |
|---|---|
| S62 | 1.3 |
| S64 | 13.5 |
| S70 | – |
| S92 | 0.43 |
| S94 | 7.2 |
| S96 | 1.33 |
| S100 | – |
| TOTAL LIQUID QUANTITY | 23.76 |

PRINTING METHOD AND PRINTING APPARATUS

BACKGROUND

1. Technical Field

The present invention relates to a printing method and a printing apparatus for use in printing images on recording media.

2. Related Art

In one known printing technology, a reaction liquid is applied to a recording medium and then color-material-containing inks are applied to the reaction liquid. The reaction liquid causes the aggregation of the color materials, helping the fixing of these color materials to the recording medium. In another known printing technology, called a "background color precoat printing method," a white ink for use in creating a background is applied to a recording medium and then color inks or other image forming inks are applied to areas of the recording medium which are coated with the white ink. If these technologies are combined, a reaction liquid is applied to a recording medium, then a white ink to the reaction liquid, and image forming inks to the white ink. In this case, a large quantity of white ink is applied to the entire surface of the recording medium in order to create the background of the image. Also, a large quantity of reaction liquid is applied in order to aggregate the white ink. Therefore, just before the image forming inks are applied, large quantities of liquids are present over the recording medium. If the image forming inks are applied to this recording medium, the image forming inks may bleed.

For example JP-A-2014-83789 describes a printing technology in which a reaction liquid is applied separately to a recording medium before a white ink is applied and before image forming inks are applied.

The technology described in JP-A-2014-83789 can decrease the quantity of the reaction liquid applied before the application of the image forming inks. However, a large quantity of reaction liquid is still needed, because the white ink is applied to the entire surface of the recording medium, in which case the image forming inks may also bleed.

The disadvantage described above commonly lies in printing technologies that use a background color ink containing a color material for a background, image forming inks for an image, and a reaction liquid. For example even if a printing method called a "background color postcoat printing method," in which image forming inks are applied to a recording medium and then a background color ink is applied to areas of the recording medium which are coated with the image forming inks is employed, a similar disadvantage may also arise. More specifically, when almost an entire surface of the recording medium is coated with image forming inks or when image forming inks that involve using a large quantity of reaction liquid for aggregation is used, for example, the background color ink may bleed.

SUMMARY

An advantage of some aspects of the invention is that a printing method and a printing apparatus capable of addressing at least a part of the above disadvantages are provided. The printing method and the printing apparatus can be embodied by aspects that will be described below.

A first aspect of the invention provides a printing method that uses a reaction liquid containing an aggregating agent capable of causing aggregation of a color material. This printing method includes: applying a first reaction liquid to a recording medium; applying a background color ink to a region of the recording medium which is coated with the first reaction liquid, the background color ink containing a color material for a background color; drying the recording medium coated with the background color ink by heating the recording medium; applying a second reaction liquid to a region of the dried recording medium which is coated with the background color ink; and applying an image forming ink to a region of the recording medium which is coated with the second reaction liquid, the image forming ink containing a color material having a color different from that of the background color ink.

According to the printing method of the first aspect, the background color ink is applied to the recording medium, and then the recording medium is dried. The image forming ink is thereby applied to the recording medium after extra moisture in the background color ink has been evaporated. This can reduce bleeding of the image forming ink.

The printing method of the first aspect may further include applying an overcoat liquid to a region of the recording medium which is coated with the first and second reaction liquids after the applying of the image forming ink.

According to the printing method described above, applying the overcoat liquid can reduce the risk that the first or second reaction liquid contacts air, especially moisture contained in air. Therefore, if a printed material is produced by this printing method, the printed material is less likely to cause disadvantages that could be attributed to the first or second reaction liquid, such as giving off a rank odor or exhibiting an adhesion property due to deliquescence of the first or second reaction liquid. In addition, this printing method allows for printing with a small total quantity of liquids.

In the printing method of the above aspect, the overcoat liquid may be applied so as to cover the region of the recording medium which is coated with the first and second reaction liquids.

According to the printing method described above, applying the overcoat liquid in the above manner can further reduce the risk that the first or second reaction liquid contacts air.

A second aspect of the invention provides a printing method that uses a reaction liquid containing an aggregating agent capable of causing aggregation of a color material. This printing method includes: applying a first reaction liquid to a recording medium; applying an image forming ink to a region of the recording medium which is coated with the first reaction liquid, the image forming ink containing a color material for use in creating an image; drying the recording medium coated with the image forming ink by heating the recording medium; applying a second reaction liquid to a region of the dried recording medium which is coated with the image forming ink; and applying a background color ink to a region of the recording medium which is coated with the second reaction liquid, the background color ink containing a color material for a background color which has a color different from the color material of the image forming ink.

According to the printing method of the second aspect, the image forming ink is applied to the recording medium, and then the recording medium is dried. The background color ink is thereby applied to the recording medium after extra moisture in the image forming ink has been evaporated. This can reduce bleeding of the background color ink.

A third aspect of the invention provides a printing apparatus that includes a reaction liquid application section that applies a reaction liquid to a recording medium, the reaction liquid containing an aggregating agent capable of causing aggregation of a color material. A background color ink application section applies a background color ink to the recording medium, the background color ink containing a color material for a background color. An image forming ink application section applies an image forming ink to the recording medium, the image forming ink containing a color material having a color different from that of the background color ink. A drying section dries the recording medium by heating the recording medium. Further, the reaction liquid application section applies a first reaction liquid to the recording medium. The background color ink application section applies the background color ink to a region of the recording medium which is coated with the first reaction liquid. After the applying of the background color ink, the drying section dries the recording medium by heating the recording medium. The reaction liquid application section applies a second reaction liquid to a region of the dried recording medium which is coated with the background color ink. The image forming ink application section applies the image forming ink to a region of the recording medium which is coated with the second reaction liquid.

According to the printing apparatus of the third aspect, the background color ink is applied to the recording medium, and then the recording medium is dried by the drying section. The reaction liquid as the second reaction liquid and the image forming ink are thereby applied to the recording medium after extra moisture in the background color ink has been evaporated. This can reduce bleeding of the image forming ink.

The printing apparatus of the third aspect may further include a transport section that can transport the recording medium in a first direction and a second direction, the first and second directions being opposite to each other. The recording medium may be coated with both the first reaction liquid and the background color ink and dried by the drying section while being transported in the first direction by the transport section. Then, the recording medium may be transported in the second direction by the transport section. The recording medium may subsequently be coated with the second reaction liquid and the image forming ink while being transported in the first direction by the transport section.

According to the printing apparatus of the third aspect, the recording medium is coated with the first reaction liquid and the background color ink, dried, and coated with the second reaction liquid and the image forming ink while being transported in the first direction by the transport section.

The printing apparatus of the third aspect may further include an overcoat liquid application section that applies an overcoat liquid to a region of the recording medium which is coated with the first and second reaction liquids.

According to the printing apparatus described above, applying the overcoat liquid can reduce the risk that the first or second reaction liquid contacts air, especially moisture contained in air. Therefore, if this printing apparatus produces a printed material, the printed material is less likely to cause disadvantages that could be attributed to the first or second reaction liquid, such as giving off a rank odor or exhibiting an adhesion property due to deliquescence of the first or second reaction liquid.

The invention can be implemented in various forms, including a printing method and a printing apparatus. For example the invention can be implemented using a print system including the printing apparatus, a method of controlling the printing apparatus or the printing system, a computer program for use in performing the control method, a nonvolatile recording medium that stores the computer program, or a printed material produced by the printing apparatus or the printing method.

BRIEF DESCRIPTION OF THE DRAWINGS

The invention will be described with reference to the accompanying drawings, wherein like numbers reference like elements.

FIG. 5 is a table of a reference example to be used to explain an effect of the first embodiment.

FIG. 6 is a table of an example in the first embodiment to be used to explain the effect of the first embodiment.

DESCRIPTION OF EXEMPLARY EMBODIMENTS

First Embodiment

Figure 1:
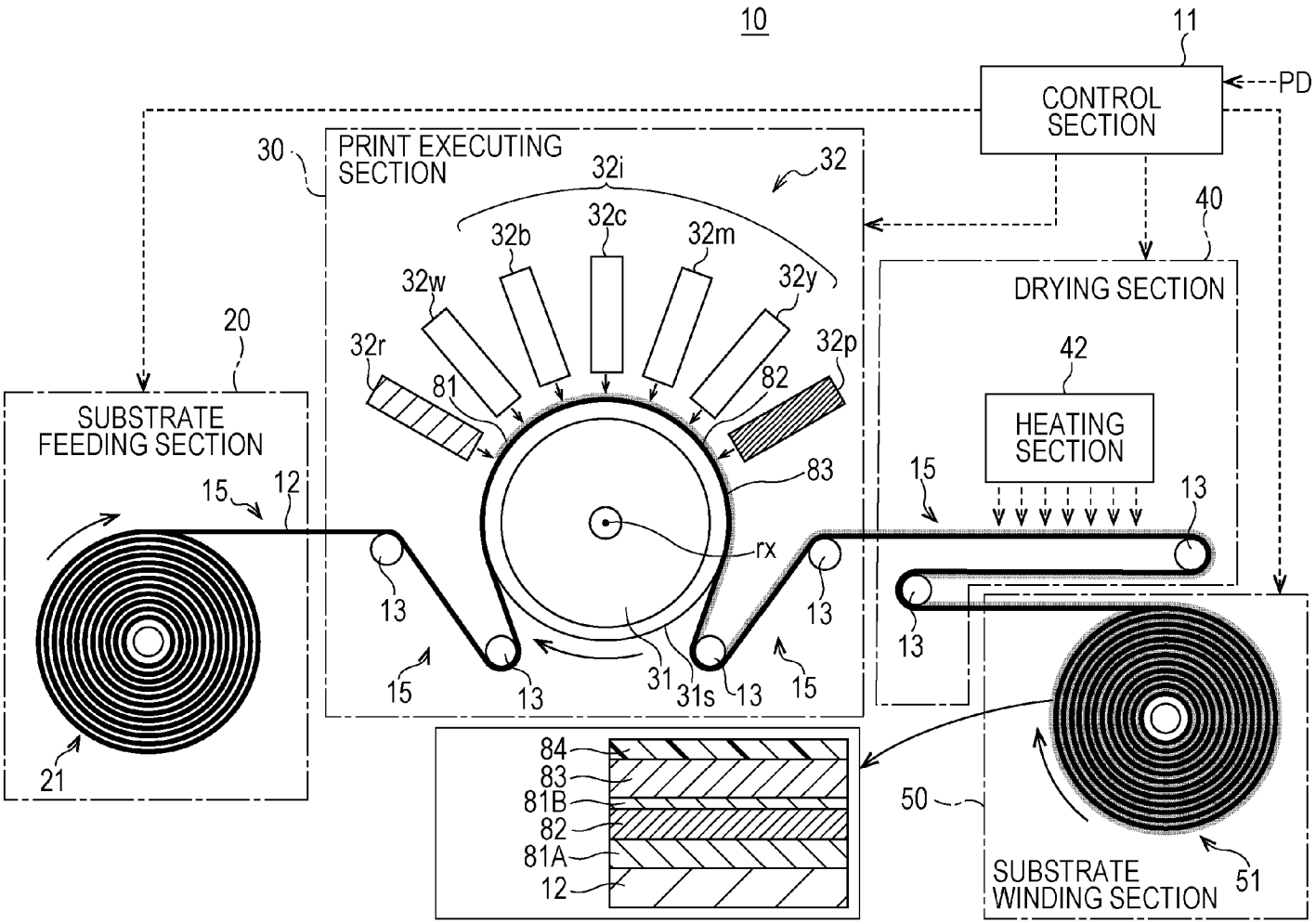
FIG. 1 schematically illustrates a configuration of a printing apparatus in a first embodiment of the invention.

FIG. 1 schematically illustrates a configuration of a printing apparatus 10 in a first embodiment of the invention. In FIG. 1, the three arrows indicate a forward rotational direction of a substrate roller 21, a rotating drum 31, and a winding roller 51. The printing apparatus 10 in the first embodiment is an ink jet line printer that creates images by ejecting ink droplets onto a printing substrate 12 as a recording medium. Specifically, the printing apparatus 10 sequentially prints images on the printing substrate 12 transported in a longitudinal direction of the printing apparatus 10. The printing substrate 12 in the first embodiment may be a transparent film. The printing apparatus 10 performs a print process for creating a background image that is to be a background and a normal image, such as a color image, over the printing substrate 12. More specifically, the printing apparatus 10 stacks a first reaction layer 81A, a background layer 82, a second reaction layer 81B, an image layer 83 and an overcoat layer 84 over the printing substrate 12 in this order. In short, this printing apparatus 10 performs a background color precoat printing method in which the background layer 82 and the image layer 83 are formed in this order.

The printing substrate 12 will be used as wrapping films for goods. The print surface of the printing substrate 12 exhibits low ink absorption. To help the fixing of ink droplets to the printing substrate 12, the printing apparatus 10 applies a reaction liquid containing an aggregating agent to the surface of the printing substrate 12 before ejecting ink droplets thereto. However, this printing method is not limiting, and the printing apparatus 10 may conform to another printing method. Examples of the printing substrate 12 include glossy paper, coated paper, OHP films, and other substrates. Alternatively, the printing substrate 12 may be an arbitrary substrate having high liquid absorption, such as plain paper, Japanese paper, or ink jet printing paper.

The printing apparatus 10 includes a control section 11, a plurality of transport rollers 13, a substrate feeding section 20, a print executing section 30, a drying section 40, and a substrate winding section 50. The control section 11 implemented using a microcomputer including a CPU and a main memory can control individual sections in the printing apparatus 10. The control section 11 acquires print data PD from an external computer or device to which the printing apparatus 10 is connected and performs the print process based on the print data PD in response to a user's instruction. The print data PD as image data may be document data on text and figures laid out, raster data on picture images, or image data created by various application programs, for example.

The plurality of transport rollers 13 constitute a transport route 15 through which the printing apparatus 10 transports the printing substrate 12 along its long side. These transport rollers 13 are placed within the printing apparatus 10 at appropriate positions such that the substrate feeding section 20, the print executing section 30, the drying section 40, and the substrate winding section 50 are arranged along the transport route 15. In this case, the substrate feeding section 20 is positioned on the "upstream side" of the transport route 15; the substrate winding section 50 is positioned on the "downstream side" of the transport route 15. Each transport roller 13 supports the printing substrate 12 along width direction of the printing substrate 12. Herein, the transport route 15 corresponds to a "transport section."

The substrate feeding section 20 is provided with the substrate roller 21 around which the printing substrate 12 is wound in roll form. The substrate roller 21 is rotated at a predetermined rotational speed by a motor (not illustrated) that the control section 11 controls, feeding the printing substrate 12 to the print executing section 30. In addition, the substrate feeding section 20 has a function of winding the printing substrate 12 that has been fed by the substrate winding section 50 and passed through the rotating drum 31. In short, in response to an instruction from the control section 11, the substrate roller 21 can rotate in the forward direction, transporting the printing substrate 12 from the upstream side to the downstream side, and can rotate in the reverse direction, transporting the printing substrate 12 from the downstream side to the upstream side. The print executing section 30 is provided with the rotating drum 31 and a print head section 32 and creates print images over the print surface of the printing substrate 12.

The rotating drum 31 is rotated at a predetermined rotational speed by a motor (not illustrated) that the control section 11 controls. The rotating drum 31 has a circumferential surface 31*s* with which the surface of the printing substrate 12 opposite the print surface makes surface contact, and transports the printing substrate 12 while supporting the printing substrate 12 with the circumferential surface 31*s*. Thus, the rotating drum 31 forms a part of the transport route 15. The transport rollers 13 are disposed both upstream and downstream of the rotating drum 31 so that a tension is applied to the printing substrate 12 on the circumferential surface 31*s* of the rotating drum 31. In response to an instruction from the control section 11, the rotating drum 31 can rotate in the forward direction, transporting the printing substrate 12 from the upstream side to the downstream side, and can rotate in the reverse direction, transporting the printing substrate 12 from the downstream side to the upstream side.

The print head section 32 has first to seventh liquid ejecting heads 32*r*, 32*w*, 32*b*, 32*c*, 32*m*, 32*y*, and 32*p*. Each of the first to seventh liquid ejecting heads 32*r* to 32*p* is a line head that ejects predetermined sized liquid droplets at predetermined timing; the size and ejection timing of the liquid droplets are determined in accordance with an instruction from the control section 11. When the printing substrate 12 passes through the print head section 32, the first to seventh liquid ejecting heads 32*r* to 32*p* eject liquid droplets onto the printing substrate 12, forming the first reaction layer 81A, the background layer 82, the second reaction layer 81B, the image layer 83, and the overcoat layer 84 over the surface of the printing substrate 12. Functions of the first to seventh liquid ejecting heads 32*r* to 32*p* and details of the first reaction layer 81A, the background layer 82, the second reaction layer 81B, the image layer 83, and the overcoat layer 84 will be described later.

The drying section 40 has a heating section 42 that heats and dries the printing substrate 12. This drying section 40 receives the printing substrate 12 from the print executing section 30, and then the heating section 42 heats and dries the printing substrate 12. The heating section 42 dries the printing substrate 12 by blowing air heated to a preset temperature to the printing substrate 12. The temperature of the air blown may be set by the control section 11; the temperature may depend on the type, property or quantity of a liquid applied to the printing substrate 12 or may be maintained at a heatproof temperature of the printing substrate 12, such as 30 to 90° C., or below. To reliably dry the printing substrate 12, the transport route 15 in the drying section 40 has a winding part of a predetermined length, causing the printing substrate 12 to reciprocate laterally multiple times.

The substrate winding section 50 is provided with the winding roller 51, which is driven to rotate at a predetermined rotational speed in response to an instruction from the control section 11. This winding roller 51 winds the printing substrate 12 fed from the drying section 40. Also, the substrate winding section 50 has a function of feeding the printing substrate 12 wound around the substrate winding section 50 itself in roll form to the drying section 40. In response to an instruction from the control section 11, the winding roller 51 can rotate in the forward direction, transporting the printing substrate 12 from the upstream side to the downstream side, and can rotate in the reverse direction, transporting the printing substrate 12 from the downstream side to the upstream side. The printing apparatus 10 configured above sequentially prints images on the printing substrate 12.

The first to seventh liquid ejecting heads 32*r* to 32*p* in the print head section 32 each have: a liquid passage including a space in which a liquid to be ejected is stored; and an element, such as a piezo element or a heater element, that can generate a driving force by which the liquid is ejected. Furthermore, the first to seventh liquid ejecting heads 32*r* to 32*p* each have a plurality of ejection holes, or nozzles, formed along the width of the printing substrate 12; the ejection holes are arranged at regular spacings according to the print resolution of the printing apparatus 10.

The first to seventh liquid ejecting heads 32*r* to 32*p* are arrayed radially with respect to the rotation axis rx of the rotating drum 31 with their nozzles facing the circumferential surface 31*s*. These first to seventh liquid ejecting heads 32*r* to 32*p* can thereby eject liquid droplets onto the print region of the printing substrate 12. Thus, in the printing apparatus 10 in the first embodiment, the rotating drum 31 functions as a so-called platen. Hereinafter, it is assumed that the first to seventh liquid ejecting heads 32*r* to 32*p* are arrayed in this order along the transport route 15 from the upstream side to the downstream side.

The first liquid ejecting head 32*r* applies droplets of a reaction liquid to the print surface of the printing substrate 12. The first reaction layer 81A or the second reaction layer 81B is thereby formed on the print surface of the printing substrate 12. The reaction liquid contains an aggregating agent that can cause the aggregation of color materials. Examples of the aggregating agent in the first embodiment include multivalent metal salts, such as calcium acetate and calcium nitrate, that can cause the aggregation of color materials, or pigment particles. The reaction liquid in the first embodiment contains approximately 1 mol/l of aggregating agent. In addition to the aggregating agent, the reaction liquid may contain water as a solvent and a surface active agent. The aggregating agent may be a multivalent metal salt other than calcium acetate and calcium nitrate. Hereinafter, the first liquid ejecting head 32*r* is also referred to as a "reaction liquid application section 32*r*."

The second liquid ejecting head 32*w* applies a background color ink to the print surface of the printing substrate 12. The background layer 82 is thereby formed on the print surface of the printing substrate 12. The background color ink contains pigment particles as a color material for the background. The background color ink in the first embodiment may be a white-based ink. Examples of white color materials (white pigments) include metal oxides, barium sulfate, and calcium carbonate; examples of metal oxides include titanium dioxide, zinc oxide, silica, alumina, and magnesium oxide. The word "white-based" does not necessarily mean pure white. The background color ink is not limited to a white-based ink and may be any ink that can form the background of the image layer 83 to be formed with image forming inks. The background color ink may be, for example, a glittering or metallic ink. The glittering ink may contain, for example, silver or aluminum particles as a color material. Thereinafter, the second liquid ejecting head 32*w* is also referred to as a "background color ink application section 32*w*."

The third to sixth liquid ejecting heads 32*b*, 32*c*, 32*m*, and 32*y*, which act as an image forming ink application section, apply image forming inks to the print surface of the printing substrate 12; each image forming ink contains a color material (pigment particles) having a color different from that of the color material contained in the background color ink. The image layer 83 is thereby formed on the print surface of the printing substrate 12. The third to sixth liquid ejecting heads 32*b*, 32*c*, 32*m*, and 32*y* eject a black-based ink, a cyan-based ink, a magenta-based ink, and a yellow-based ink, respectively. Each of the background color ink and the image forming inks may be a water-based ink and may contain water as a main solvent accordingly. The combination of the third to sixth liquid ejecting heads 32*b*, 32*c*, 32*m*, and 32*y* in the first embodiment is referred to as an image forming ink application section 32*i*.

The seventh liquid ejecting head 32*p* applies an overcoat liquid or an overprint liquid to at least a region on the print surface of the printing substrate 12 which is coated with the reaction liquid. The overcoat layer 84 is thereby formed on the print surface of the printing substrate 12. Hereinafter, the seventh liquid ejecting head 32*p* is referred to as an "overcoat liquid application section 32*p*." The word "overcoat" herein refers to a translucent resin film formed by depositing and drying an ink material over a print image. The word "overcoat liquid" refers to an ink material used for the overcoat; the word "overcoat layer" refers to a liquid layer made of this ink material or a film layer formed by drying this liquid layer.

The overcoat liquid in the first embodiment may be a solution in which at least one of resins described below is dispersed in an inorganic or organic solvent. By using at least one of the resins described below, a substantially transparent film can be formed as the overcoat layer, although there is no limitation on the resin material used for the overcoat liquid. Examples of the resin contained in the overcoat liquid include a styrene-acrylonitrile-based resin, a polyethylene-based resin, a urethane-based resin, a polyester-based resin, an acrylic-based resin, and a fluorine-based resin.

In the printing apparatus 10 in the first embodiment, the reaction liquid application section 32*r* and the overcoat liquid application section 32*p* each have a lower nozzle resolution than the background color ink application section 32*w* and the image forming ink application section 32*i*. The word "nozzle resolution" refers to the number of nozzles per unit length. Assuming that the image forming ink application section 32*i* and the background color ink application section 32*w* each have a nozzle resolution of 1200 dpi, the reaction liquid application section 32*r* and the overcoat liquid application section 32*p* may each have a nozzle resolution of approximately 600 dpi.

The reaction liquid and the overcoat liquid tend to spread out more widely over the surface of the printing substrate 12 than the image forming inks. Therefore, the reaction liquid application section 32*r* and the overcoat liquid application section 32*p* that have a lower nozzle resolution can eject the reaction liquid and the overcoat liquid, respectively, such that adjacent droplets are connected to one another. It is thus possible to form the first reaction layer 81A, the second reaction layer 81B, and the overcoat layer 84 so as to seamlessly cover the same area as the background layer 82 and the image layer 83. Moreover, decreasing the nozzle resolution of the reaction liquid application section 32*r* and the overcoat liquid application section 32*p* can reduce excessive use of the reaction liquid and the overcoat liquid and can decrease the number of components therein, thus lowering fabricating costs of the printing apparatus 10.

When the printing apparatus 10 performs the print process, the control section 11 controls the first to seventh liquid ejecting heads 32*r* to 32*p* to eject liquid droplets onto the printing substrate 12, on the basis of the print data PD. A description will be given below of the print process performed by the control section 11 and a manner in which the control section 11 controls the first to seventh liquid ejecting heads 32*r* to 32*p* in the print process.

Figure 2:
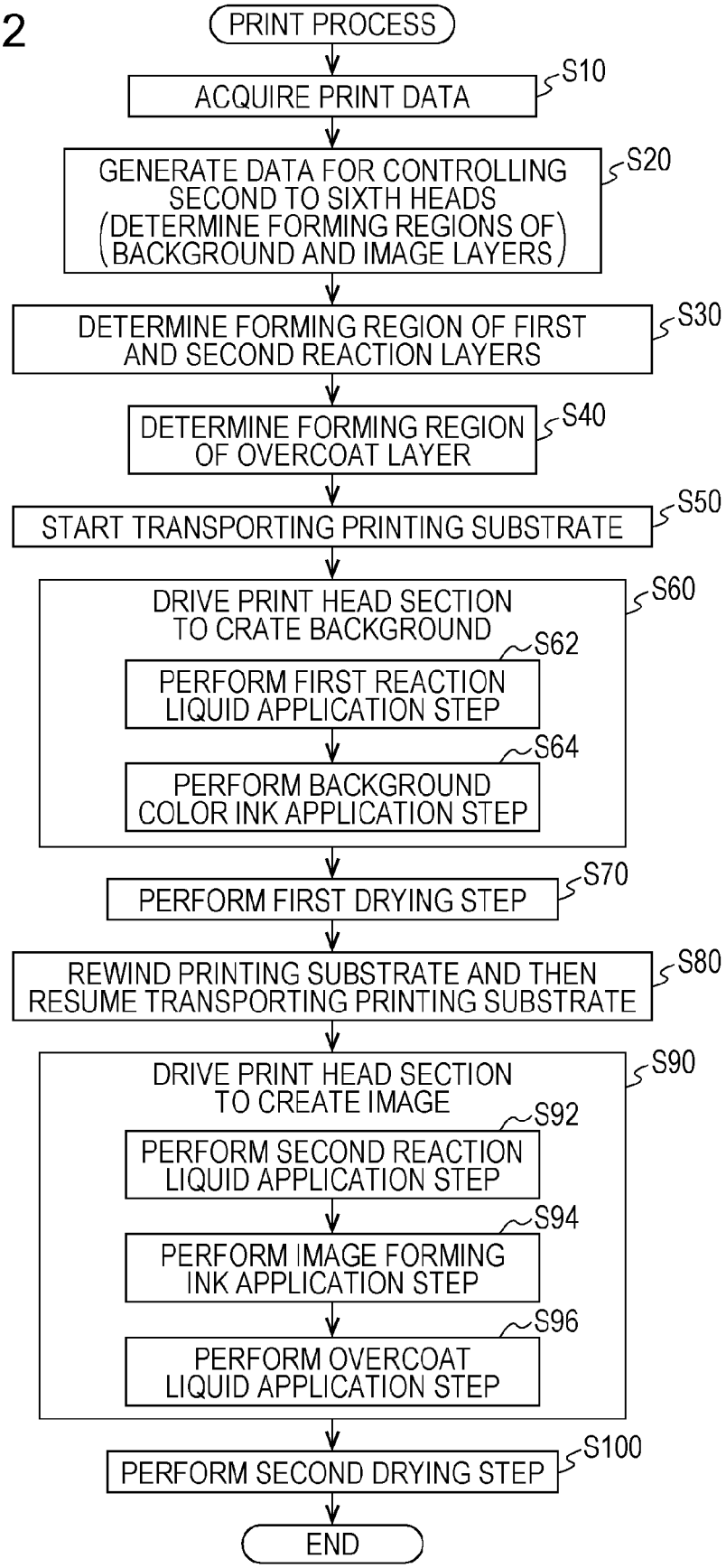
FIG. 2 is a flowchart of a print process performed by the control section.
Figure 3:
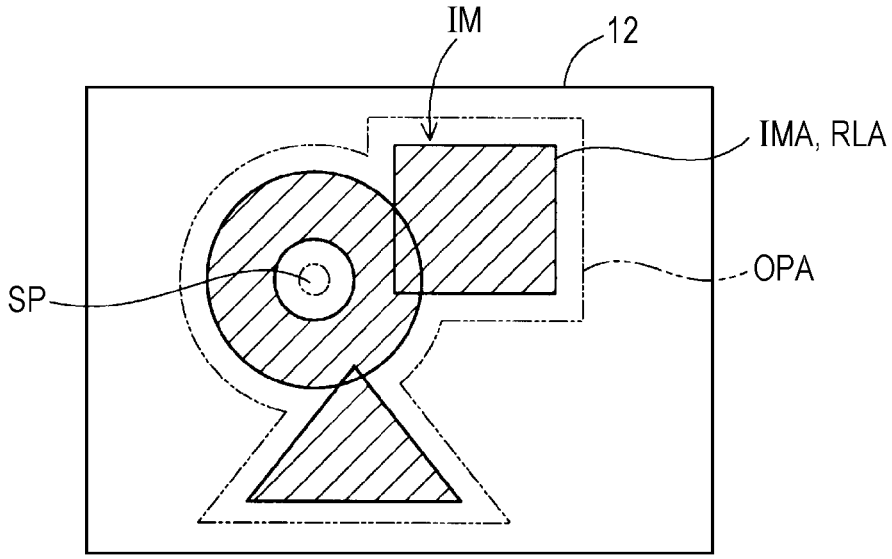
FIG. 3 schematically illustrates the forming regions of the individual layers.

FIG. 2 is a flowchart of the print process performed by the control section 11. FIG. 3 schematically illustrates the forming regions of the individual layers. In FIG. 3, an exemplary print image IM is formed over the printing substrate 12, a forming region IMA of the background layer 82 and the image layer 83 is hatched, and a forming region RLA of the first reaction layer 81A and the second reaction layer 81B coincides with the forming region IMA. A forming region OPA of the overcoat layer 84 is indicated by an alternate long and two short dashes line.

At Step S10 (FIG. 2), the control section 11 acquires the print data PD described above. At Step S20, the control section 11 generates data for use in controlling the second to sixth liquid ejecting heads 32*w*, 32*b*, 32*c*, 32*m*, and 32*y* to eject the inks, on the basis of the print data PD. More specifically, the control section 11 analyzes colors of an image expressed by the print data PD and subjects each color to a half-tone process. Then, the control section 11 generates control data that indicates the timing at which the second to fifth liquid ejecting heads eject ink droplets through the nozzles. It should be noted that regions in which the background layer 82 and the image layer 83 are to be formed is determined at Step S20. The regions in which the background layer 82 and the image layer 83 are to be formed may be substantially coincide with each other. The print data PD may be composed of a single piece of data or two pieces of data for a background and an image. Continuing, at Steps S30 and S40, the control section 11 determines both the forming region RLA of the first reaction layer 81A and the second reaction layer 81B and the forming region OPA of the overcoat layer 84, on the basis of the forming region IMA of the background layer 82 and the image layer 83 which has been determined at Step S20. Then, the control section 11 generates control data for use in controlling the reaction liquid application section 32*r* and the overcoat liquid application section 32*p* to eject liquid droplets through the nozzles, on the basis of the determined forming regions RLA and OPA.

As illustrated in FIG. 3, the forming region IMA of the background layer 82 and the image layer 83 corresponds to an area of the print image IM which is colored with at least one of the five color inks. The first reaction layer 81A and the second reaction layer 81B in the first embodiment are formed within an area that extends at the periphery of the background layer 82 and the image layer 83 so as to contain the forming region IMA of the background layer 82 and the image layer 83. In the first embodiment, the outer edge of the forming region RLA of the first reaction layer 81A and the second reaction layer 81B substantially conforms to that of the forming region IMA of the background layer 82 and the image layer 83. Alternatively, the outer edge of the forming region RLA of the first reaction layer 81A and the second reaction layer 81B may be formed outside that of the forming region IMA of the background layer 82 and the image layer 83.

The overcoat layer 84 is formed over the forming region RLA on the print surface of the printing substrate 12 which is coated with the reaction liquid. The overcoat layer 84 in the first embodiment is formed so as to cover both the forming region IMA and the forming region RLA. Thus, the outer edge of the forming region OPA of the overcoat layer 84 is formed along and outside the outer edge of the forming region RLA of the first reaction layer 81A and the second reaction layer 81B. In this case, for example the outer edge of the forming region OPA of the overcoat layer 84 may be several millimeters away from the outer edge of the forming region RLA of the first reaction layer 81A and the second reaction layer 81B. However, both outer edges do not necessarily have to be a constant distance away from each other. Moreover, if the first reaction layer 81A and the second reaction layer 81B contain a blank region SP, the forming region OPA of the overcoat layer 84 has an inner edge inside this blank region SP. Alternatively, the overcoat layer 84 may be formed within the entire blank region SP. The forming region of the background layer 82, the forming region RLA of the first reaction layer 81A and the second reaction layer 81B, and the forming region OPA of the overcoat layer 84 may be formed over an entire possible area on the print surface of the printing substrate 12.

At Step S50 (see FIG. 2), the control section 11 drives the substrate roller 21, the rotating drum 31, and the winding roller 51 to rotate in the forward direction, thereby starting to transport the printing substrate 12 along the transport route 15 from the substrate feeding section 20 to the substrate winding section 50. Simultaneously, the control section 11 may start to operate the heating section 42.

At Step S60, the control section 11 drives the print head section 32 to create the background. More specifically, the control section 11 drives both the reaction liquid application section 32*r* and the background color ink application section 32*w* in the print head section 32, on the basis of the pieces of control data generated at Steps S20 and S30. In the printing apparatus 10 in the first embodiment, the reaction liquid application section 32*r* and the background color ink application section 32*w* are arrayed in this order from the upstream side to the downstream side. At Step S62, the control section 11 performs a first reaction liquid application step at which the reaction liquid application section 32*r* applies the reaction liquid as a first reaction liquid to the printing substrate 12 while transporting the printing substrate 12 from the upstream side to the downstream side. At Step S64, the control section 11 performs a background color ink application step at which the background color ink application section 32*w* applies the background color ink to the forming region RLA (see FIG. 3) that has been coated with the reaction liquid (first reaction liquid) at Step S62. In this way, the first reaction layer 81A and the background layer 82 (FIG. 1) are formed.

At Step S70, the control section 11 performs a first drying step as a drying step. At this first drying step, the heating section 42 in the drying section 40 dries the printing substrate 12 coated with the reaction liquid and the background color ink. In this case, the heating section 42 blows hot air to the printing substrate 12. The temperature of this hot air is determined by the control section 11, in accordance with the quantities of the reaction liquid and background color ink applied to the printing substrate 12. For example the temperature of the hot air may be set such that the reaction liquid and the background color ink that have been applied to the printing substrate 12 at Step S60 are fixed thereto, that is, such that the solvents in the reaction liquid and the background color ink are sufficiently evaporated. More specifically, as larger quantities of reaction liquid and background color ink have been applied to the printing substrate 12 at Step S60, the hot air is set to a higher temperature. The setting in this manner can reduce bleeding of the reaction liquid and the background color ink over the printing substrate 12 and can prevent liquid to be applied to the printing substrate 12 at a following step from transferring from the printing substrate 12 to another. In the printing apparatus 10 in the first embodiment, the heating section 42 may directly blow the hot air to the printing substrate 12 over a fixed period of time. It should be noted that there is no limitation on a manner in which the control section 11 controls the heating section 42. Alternatively, the hot air may be set to a fixed temperature, such as 70° C., independently of the quantities of the reaction liquid and the background color ink applied to the printing substrate 12. The printing substrate 12 that has been subjected to Step S70 is wound around the winding roller 51 in the substrate winding section 50.

At Step S80, the control section 11 rewinds the printing substrate 12, and then resumes transporting the printing substrate 12 from the substrate feeding section 20 to the substrate winding section 50. More specifically, the control section 11 starts to drive the substrate roller 21, the rotating drum 31, the winding roller 51 to rotate in the reverse direction, transporting the printing substrate 12 along the transport route 15 from the substrate winding section 50 to the substrate feeding section 20. In this way, the printing substrate 12 is rewound around the substrate roller 21. Then, the control section 11 resumes transporting the rewound printing substrate 12 along the transport route 15 from the substrate feeding section 20 to the substrate winding section 50. When the printing substrate 12 is rewound, the control section 11 may or may not stop the operation of the heating section 42. If the heating section 42 stops its operation when the printing substrate 12 is rewound, the heating section 42 preferably resumes its operation until Step S100 that will be described later has started.

The control section 11 drives the print head section 32 to create the image (Step S90). More specifically, the control section 11 drives the reaction liquid application section 32*r*, the image forming ink application section 32*i*, and the overcoat liquid application section 32*p* in the print head section 32, on the basis of the pieces of control data generated at Steps S20 to S40. In the printing apparatus 10 in the first embodiment, the reaction liquid application section 32*r*, the image forming ink application section 32*i*, and the overcoat liquid application section 32*p* are arrayed in this order from the upstream side to the downstream side. At Step S92, the control section 11 performs a second reaction liquid application step at which the reaction liquid application section 32*r* applies the reaction liquid as a second reaction liquid to the printing substrate 12 while transporting the printing substrate 12 from the upstream side to the downstream side. Then, at Step S94, the control section 11 performs an image forming ink application step at which the image forming ink application section 32*i* applies the image forming inks to the region RLA that has been coated with the reaction liquid, or the second reaction liquid, at Step S92. Subsequent to Step S94, at Step S96, the control section 11 performs an overcoat liquid application step at which the overcoat liquid application section 32*p* applies the overcoat liquid to both the forming region RLA of the first reaction layer 81A and the second reaction layer 81B and the forming region IMA of the background layer 82 and the image layer 83 so as to cover the forming regions RLA and IMA. In this way, the second reaction layer 81B, the image layer 83, and the overcoat layer 84 are formed at Step S90.

At Step S100, the control section 11 performs a second drying step. At this second drying step, the heating section 42 dries the printing substrate 12 coated with the reaction liquid as the second reaction liquid, the image forming ink, and the overcoat liquid, similar to the first drying step. The temperature of the hot air that the heating section 42 blows to the printing substrate 12 is determined by the control section 11, in accordance with the quantities of the liquids, or the reaction liquid, the image forming inks, and the overcoat liquid, that have been applied to the printing substrate 12 at Step S90, although there is no limitation on a manner in which the control section 11 controls the heating section 42. Alternatively, the hot air may be set to a fixed temperature, such as 70° C., independently of the quantities of the reaction liquid, the image forming ink, and the overcoat liquid applied to the printing substrate 12. The printing substrate 12 that has been subjected to Step S100 is wound around the winding roller 51 in the substrate winding section 50.

Figure 4:
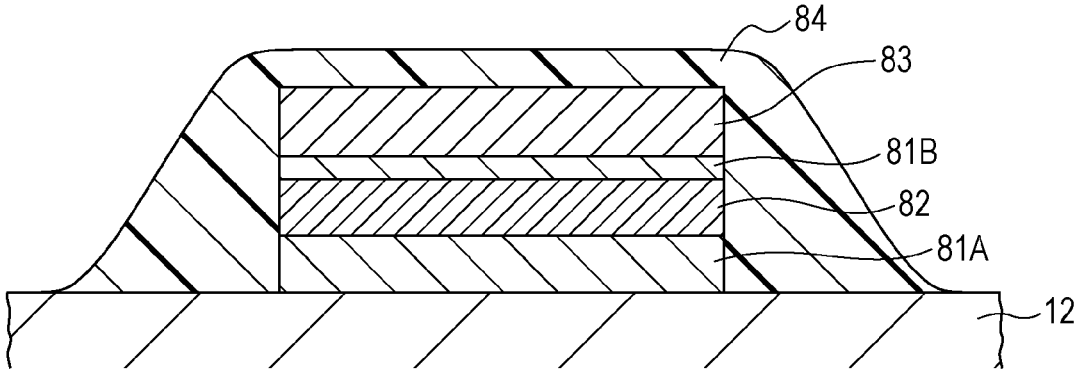
FIG. 4 illustrates a layered structure of the printing substrate that has been subjected to Step S100.

FIG. 4 illustrates a layered structure of the printing substrate 12 that has been subjected to Step S100. As illustrated in FIG. 4, the first reaction layer 81A made of the first reaction liquid, the background layer 82 made of the background color ink, the second reaction layer 81B made of the second reaction liquid, and the image layer 83 made of the image forming inks are stacked, in this order, over the printing substrate 12 that has been subjected to Step S100. Furthermore, the overcoat layer 84 made of the overcoat liquid is formed over the printing substrate 12 so as to cover the first reaction layer 81A, the background layer 82, the second reaction layer 81B, and the image layer 83. If a person views the printing substrate 12 from the surface over which the first reaction layer 81A to the overcoat layer 84 are formed, the person can visually identify the image created with the image layer 83. The printing substrate 12 that has been subjected to Step S100 will be cut into some pieces of a predetermined length, and they will be used as labels, for example.

According to the first embodiment described above, at first, a printing apparatus 10 performs a background color ink application step, and then performs a first drying step at which extra moisture in a reaction liquid and a background color ink applied to the printing substrate 12 is evaporated. After that, the printing apparatus 10 applies image forming inks to the printing substrate 12. The printing apparatus 10 thereby reduces bleeding of the image forming inks, making it possible to create a high-quality image on the printing substrate 12. Second, the printing apparatus 10 performs an overcoat liquid application step at which an overcoat liquid is applied to the printing substrate 12 so as to cover both a forming region RLA (see FIG. 3) coated with the reaction liquid and a forming region IMA (see FIG. 3) coated with the background color ink and the image forming inks. Applying the overcoat liquid in this manner can reduce the risk that the reaction liquid contacts air, especially moisture contained in air. Therefore, if the printing apparatus 10 produces a printed material, this printed material is less likely to cause disadvantages that could be attributed to the reaction liquid, such as giving off a rank odor or exhibiting an adhesion property due to deliquescence of the reaction liquid. Third, the printing apparatus 10 sequentially performs a first reaction liquid application step (Step S60), the background color ink application step (Step S64), and a first drying step (Step S70) while transporting the printing substrate 12 along a transport route 15 in a first direction, or in the direction from the upstream side to the downstream side. After that, the printing apparatus 10 rewinds the printing substrate 12 in a second direction, or in the direction from the downstream side to the upstream side (Step S80). Subsequent to Step S80, the printing apparatus 10 performs a second reaction liquid application step (Step S92) and an image forming ink application step (Step S94) while re-transporting the printing substrate 12 along the transport route 15 in the first direction. In this way, Steps S62, S64, S70, S92, and S94 are performed while the printing substrate 12 is being transported in the first direction. This enables the printing apparatus 10 to perform the print process by using a single print executing section 30. Consequently, the printing apparatus 10 can be fabricated at a low cost.

FIG. 5 is a table of a reference example to be used to explain an effect of the first embodiment. FIG. 6 is a table of an example in the first embodiment to be used to explain the effect of the first embodiment. The data in FIG. 5 was obtained through the print process in the first embodiment from which the first drying step (Step S70) was removed. FIGS. 5 and 6 show liquid quantities (mg/in$^2$) per square inch at each step when images were created on printing substrates 12 on the basis of the same print data PD. According to FIG. 5, for example, 1.3 mg/in$^2$ of liquid was used at Step S62, or at the first reaction liquid application step. The total liquid quantity in each of FIGS. 5 and 6 corresponds to the total quantity of liquids used at all the steps. The quantity of overcoat liquid at Step S100 in each of FIGS. 5 and 6 which needs to eliminate an odor of the reaction liquid from the printing substrate 12 is determined with a sensory inspection (an inspection using a smelling sense). FIGS. 5 and 6 reveal that the print process in the first embodiment can reduce an odor of a reaction liquid, which is its harmful effect, with a smaller quantity of overcoat liquid. A possible reason for this is that drying a reaction liquid that has been applied at Step S60 at a first drying step (Step S70 in FIG. 2) decreases the quantity of unreacted reaction liquid that could be the odor source. In addition, the decrease in the quantity of overcoat liquid lightens a load that would be placed on a drying section 40 at a second drying step (Step S100). It is thus possible to lower a temperature of hot air blown by a heating section 42 at a second drying step and to decrease the total quantity of liquids used to perform the print process.

Second Embodiment

Figure 7:
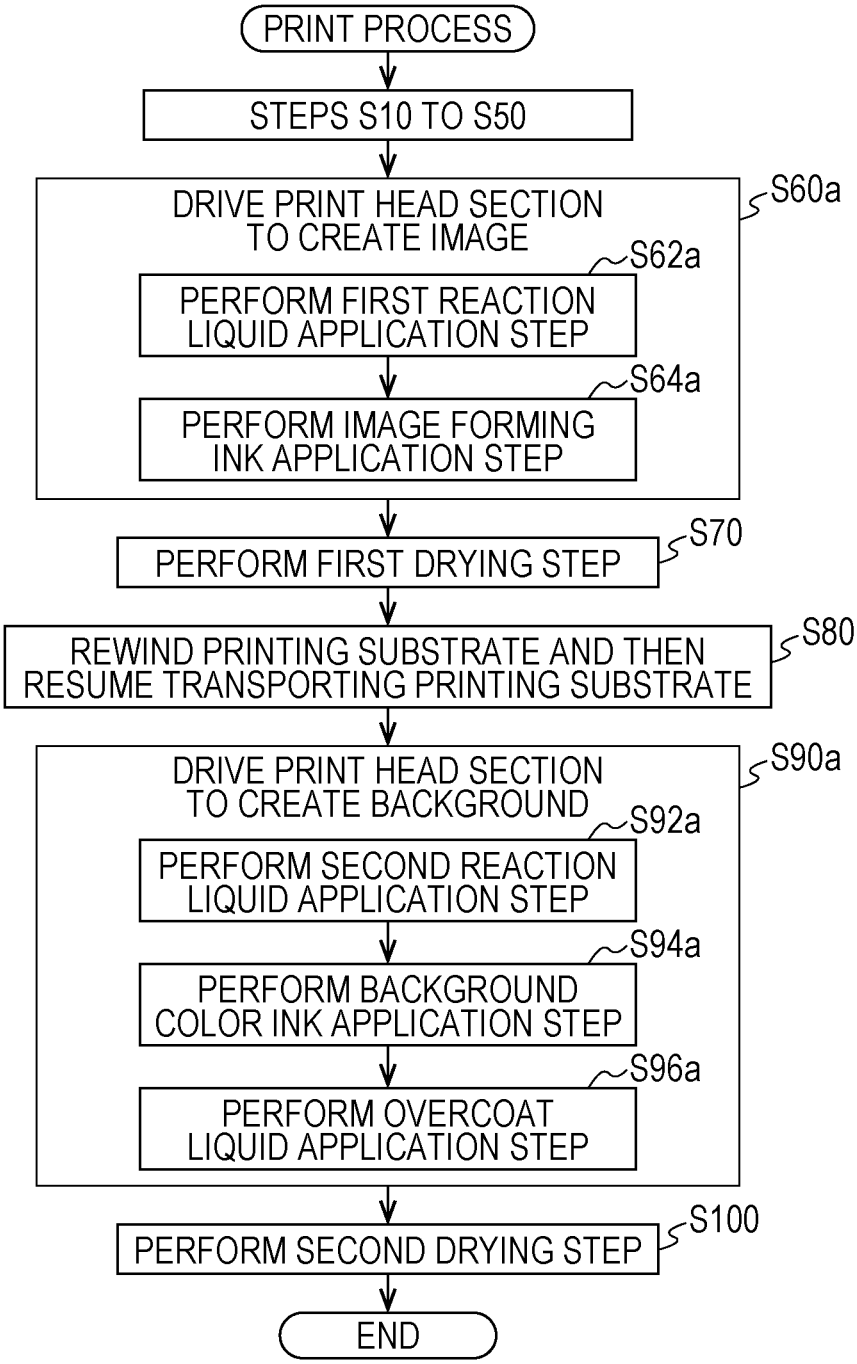
FIG. 7 is a flowchart of a print process in a second embodiment of the invention.

FIG. 7 is a flowchart of a print process in a second embodiment of the invention. The steps in the flowchart shown in FIG. 7 are performed by a control section 11 (see FIG. 1) in a printing apparatus 10 in the first embodiment. The second embodiment differs from the first embodiment in the order in which the first reaction layer 81A, the background layer 82, the second reaction layer 81B, the image layer 83, and the overcoat layer 84 are stacked over the printing substrate 12. More specifically, in the print process in the second embodiment, first the image layer 83 is formed and then the background layer 82 is formed. In other words, the print process employs the background color postcoat printing method. Steps in the second embodiment which are identical to those in the first embodiment are given the same reference numbers and will not be described.

After Step S50, the control section 11 drives the print head section 32 to create an image at Step S60*a*. Specifically, a first reaction liquid application step performed at Step S62*a* in Step S60*a* is identical to the second reaction liquid application step at Step S92 in FIG. 2; an image forming ink application step performed at Step S64*a* in Step S60*a* is identical to that at Step S94 in FIG. 2. Subsequently, the control section 11 performs Steps S70 and S80 and then drives the print head section 32 to create the background at Step S90*a*. Specifically, a second reaction liquid application step at Step S92*a* in Step S90*a* is identical to the first reaction liquid application step at Step S62 in FIG. 2; a background color ink application step at Step S94*a* of Step S90*a* is identical to that at Step S64 in FIG. 2. In this case, the temperature of hot air that a heating section 42 blows to a printing substrate 12 at Step S70 is determined by the control section 11, for example in accordance with the quantities of the liquids that have been applied to the printing substrate 12 at Step S60*a*. Likewise, the temperature of hot air that the heating section 42 blows to the printing substrate 12 at Step S100 is determined by the control section 11, for example in accordance with the quantities of the liquids that have been applied to the printing substrate 12 at Step S90*a*. Alternatively, the heating section 42 may blow hot air of a fixed temperature in the range of 30 to 90° C., for example, to the printing substrate 12 at Steps S60*a* and S100. Then, the printing substrate 12 that has been subjected to Step S100 is wound around the winding roller 51 in the substrate winding section 50. If a person views the printing substrate 12 that has been subjected to the print process in the second embodiment from the surface opposite to that over which the first reaction layer 81A to the overcoat layer 84 are formed, the person can visually identify the image created from the image layer 83.

The same steps as in the first embodiment are performed in the second embodiment described above, and thus the second embodiment produces the same effects as the first embodiment. To give an example, a printing apparatus 10 performs an image forming ink application step, and then performs a first drying step at which extra moisture in a reaction liquid and image forming inks applied to the printing substrate 12 is evaporated. After that, the printing apparatus 10 applies a background color ink to the printing substrate 12. The printing apparatus 10 thereby reduces bleeding of the background color ink, making it possible to create a high-quality image on the printing substrate 12. To give another example, the printing apparatus 10 performs an overcoat liquid application step, which can reduce the risk that the reaction liquid contacts air, especially moisture contained in air. Therefore, if the printing apparatus 10 produces a printed material, this printed material is less likely to cause disadvantages that could be attributed to the reaction liquid, such as giving off a rank odor or exhibiting an adhesion property due to deliquescence of the reaction liquid. In addition, the printing apparatus 10 can perform a print process with a smaller total quantity of liquids.

Modification

The invention is not limited to the first and second embodiments described above, and these embodiments can be modified in various ways without departing from the spirit of the invention. Exemplary modifications will be described below.

First Modification

Instead of a drying section 40 having a heating section 42 that blows hot air, another configuration that dries a printing substrate 12 may be used. For example a transport belt or some other structure that supports the printing substrate 12 may be installed as a part of a transport route, and a heater may be provided in this structure as a heating section 42.

Second Modification

In the first and second embodiments described above, a printing apparatus 10 drives a substrate roller 21, a rotating drum 31, and a winding roller 51 to rotate in a reverse direction, rewinding a printing substrate 12 from a substrate winding section 50 to a substrate feeding section 20 (Step S80 in FIGS. 2 and 7). In addition, the printing apparatus 10 performs a second drying step (Step S100 in FIGS. 2 and 7). However, the printing apparatus 10 does not necessarily have to perform the rewinding and second drying steps. Alternatively, the printing apparatus 10 may sequentially perform all steps in a print process other than Step S100 while transporting a printing substrate 12 from a substrate feeding section 20 to a substrate winding section 50. In this case, the printing apparatus 10 may be modified so as to be able to sequentially perform all the steps in a print process other than Step S100 while transporting a printing substrate 12. If the printing apparatus 10 in the first embodiment performs a print process, an additional print executing section 30 may be installed along a transport route 15 between the drying section 40 and the substrate winding section 50. If the printing apparatus 10 sequentially performs the steps while transporting the printing substrate 12, the print executing section 30 (see FIG. 1) installed between the substrate feeding section 20 and the drying section 40 does not have to be provided with an image forming ink application section 32*i* and an overcoat liquid application section 32*p*. Likewise, the additional print executing section 30 does not have to be provided with a background color ink application section 32*w*.

Third Modification

An overcoat liquid in the first and second embodiments is applied so as to cover a forming region RLA (see FIG. 3) coated with a first reaction liquid and a second reaction liquid; however, there is no limitation on a method of applying the overcoat liquid. Alternatively, the overcoat liquid may be applied so as to at least partially cover the forming region RLA. This can also reduce an odor of the reaction liquid.

Fourth Modification

In the first and second embodiments, the same reaction liquid is used to cause the aggregation of a background color ink and image forming inks; however, different reaction liquids may be used separately. For example a first reaction liquid and a second reaction liquid may be selected depending on properties of a background color ink and image forming inks, respectively. In this case, the first reaction liquid readily causes the aggregation of a background color ink, and a second reaction liquid readily causes the aggregation of image forming inks.

The entire disclosure of Japanese Patent Application No. 2014-228071, filed Nov. 10, 2014 is expressly incorporated by reference herein.

What is claimed is:

1. A printing method that uses a reaction liquid containing an aggregating agent capable of causing aggregation of a color material, the printing method comprising:

applying a first reaction liquid to a recording medium;

applying a background color ink to a region of the recording medium which is coated with the first reaction liquid, the background color ink containing a color material for a background color;

drying the recording medium coated with both the first reaction liquid and the background color ink by heating the recording medium;

following drying the recording medium, applying a second reaction liquid to a region of the dried recording medium which is coated with the background color ink; and applying an image forming ink to a region of the recording medium which is coated with the second reaction liquid, the image forming ink containing a color material having a color different from that of the background color ink.

2. The printing method according to claim 1, further comprising applying an overcoat liquid to a region of the recording medium which is coated with the first and second reaction liquids after the applying of the image forming ink.

3. The printing method according to claim 2, wherein the overcoat liquid is applied so as to cover the region of the recording medium which is coated with the first and second reaction liquids.

* * * * *